US006050158A

United States Patent [19]

Cassutti et al.

[11] Patent Number: 6,050,158

[45] **Date of Patent: *Apr. 18, 2000**

[54] ADJUSTMENT HAND TOOL/SCREWDRIVER

[76] Inventors: Paolo Cassutti, 8 N. Creek Rd., Northport, N.Y. 11729; Wayne Anderson, 65 Grove St., Northport, N.Y. 11768

[ * ] Notice: This patent is subject to a terminal disclaimer.

[21] Appl. No.: 09/192,660

[22] Filed: Nov. 16, 1998

Related U.S. Application Data

[63] Continuation of application No. 08/846,070, Apr. 25, 1997, Pat. No. 5,868,048.

[51] Int. Cl.[7] ..... B25G 1/08

[52] U.S. Cl. ..... 81/490; 81/439

[58] Field of Search ..... 81/438, 439, 489, 81/490, 58, 58.1, 177.1, 177.4, 492

[56] References Cited

U.S. PATENT DOCUMENTS 2,620,001 12/1952 Fratz et al. ..... 81/177.1

3,770,153 11/1973 Gach et al. .

4,300,607 11/1981 Mellinger ..... 81/490

FOREIGN PATENT DOCUMENTS 1578372 11/1980 United Kingdom ..... 81/177.4

*Primary Examiner*—David A. Scherbel

*Assistant Examiner*—Joni B. Danganan

*Attorney, Agent, or Firm*—Lackenbach Siegel

[57] ABSTRACT

A hand tool in the form of a magnetic screwdriver, having a handle provided with a cavity for storing a plurality of tool bits, and a removable cap, and the cap has a recess with means for securely holding and driving a tool bit placed in said recess so as to form an extra, small-independent, stubby like adjustment screwdriver as a separate specialized second screwdriver.

12 Claims, 3 Drawing Sheets

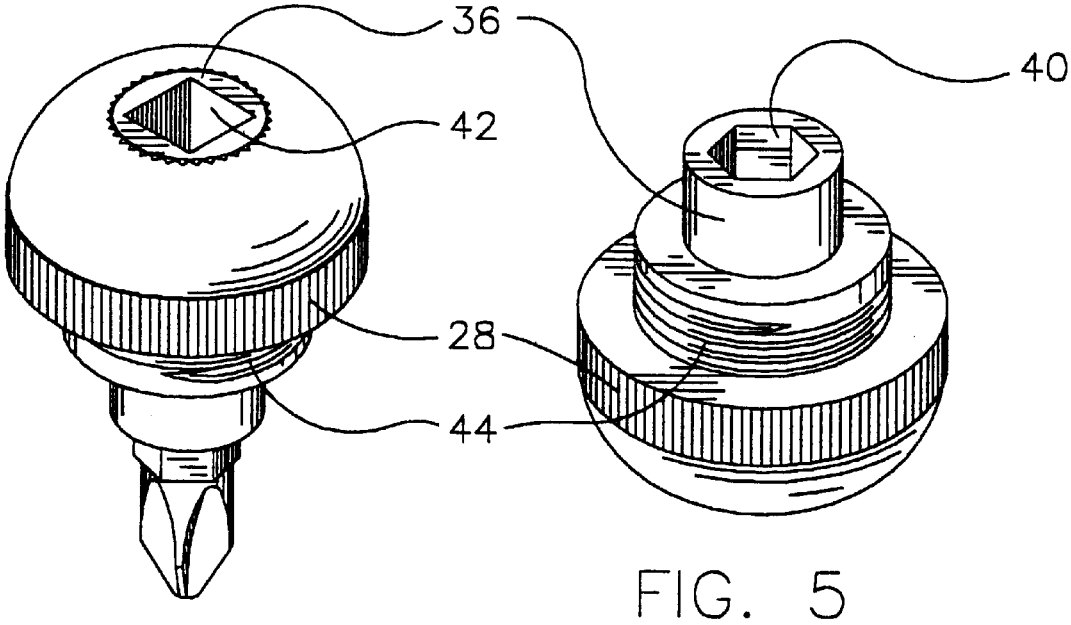
FIG. 5
FIG. 4
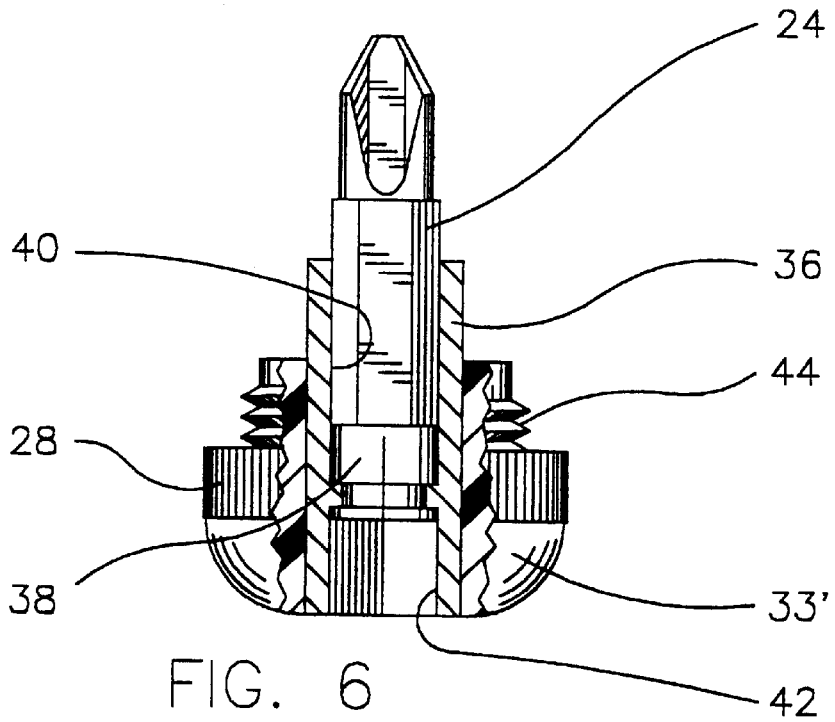
FIG. 6

ADJUSTMENT HAND TOOL/SCREWDRIVER

This is a continuation of application Ser. No. 08/846,070, filed Apr. 25, 1997, now U.S. Pat. No. 5,868,048.

This invention relates to a hand tool, and more particularly to a magnetic screwdriver having a handle provided with a cavity, for storing and retaining a plurality of bit drivers, with a removable cap. The invention further provides another extra, short screwdriver tool which is readily adapted to be finger held and used as a finger tip sized adjustment screwdriver.

BACKGROUND OF THE INVENTION

In numerous industrial applications where various equipment and machinery are employed, mechanics or other personnel responsible for the control and maintenance of such machines and apparatus or equipment are in constant need of small screwdrivers for making slight adjustments to the machines, sometimes in tight areas or quarters. While the mechanics may not have a tool chest handy, they invariably have a large or big screwdriver in their rear pocket or belt accessory, but they do not normally have a small finger tip-sized adjustment screwdriver tool which is generally of the type required for use in such. situations where machines require small adjustments.

SUMMARY OF THE INVENTION

In accordance with the invention, there is provided a hand tool, such as in the plurality of tool bits, an a removable cap; and the cap has a recess with means for securely holding and driving a tool bit placed in said recess so as to form an extra, small-independent, stubby-like adjustment screwdriver as a separate specialized second screwdriver. In a further application of the invention, the recess is a blind, hexagonal-shaped hole with a bottom from mutually cooperative association with hexagonal-shaped tool bit.

A further improvement of the invention is provided where the cap is provided with threaded means on a neck area of said cap; and the recess is further provided with a protuberance adjacent to the bottom of the hexagonal shaped hole for securely retaining in place a tool bit inserted into the hexagonal shaped hole. Other features and improvements of the invention will be more particularly described herein with reference to the following specification when taken with reference to the accompanying drawings.

BRIEF DESCRIPTION OF THE DRAWINGS

FIG. 4 is an alternate embodiment of the improved cap of FIGS. 1–3, but showing in perspective a metal insert with dual recessed ends, one end for creating a full magnetic hand tool, such as the magnetic screwdriver, and the other or back end for employing a drive element, such as a ¼inch square driver or Allen wrench in the case of employing a hexagonal recess and mating driver;

FIG. 5 is a perspective view opposite to that of FIG. 4, but showing the hexagonal drive recess without the Phillips screwdriver bit;

FIG. 6 is a side elevational view, partly in section showing the metal insert, magnet element and tool bit in the alternate form of the improved plastic cap;

DESCRIPTION OF THE PREFERRED EMBODIMENTS

In all of the embodiments of the improved cap of the invention, it should be recognized that their elements or features are "interchangeable" or can be used in any one embodiment. Thus, for example, the locking thread means of FIGS. 7–8 can be used with the embodiments of FIGS. 1–6, or the improved cap of FIGS. 1–3 may be used with a locking thread means to mate with the tool handle of FIGS. 7–8. Also, like numerals or prime reference numbers refer to similarly constructed elements.

Figure 2:
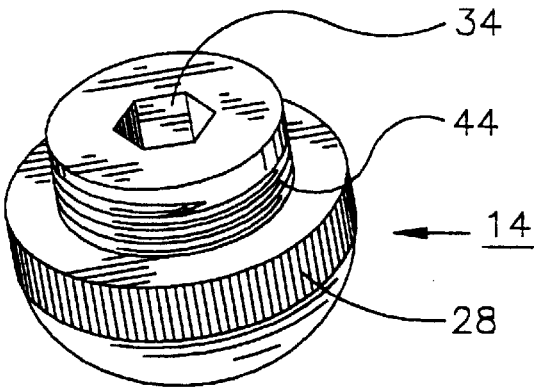
FIG. 2 is a perspective view of the improved cap showing a polygonal aperture, such as a hexagonal recess-bore hole for use with a tool bit, such as a screwdriver bit.
Figure 3:
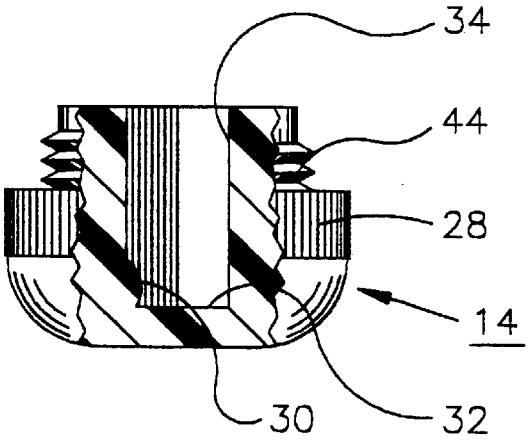
FIG. 3 is a typical cross sectional view of the improved cap showing the hexagon recess bore hole.
Figure 1:
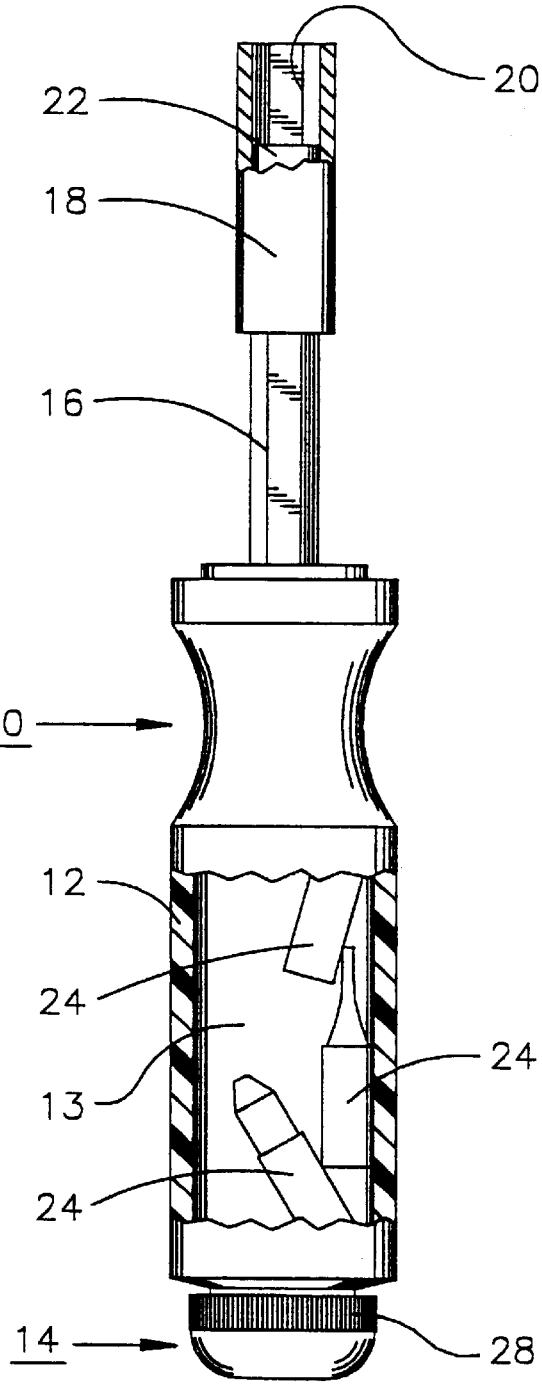
FIG. 1 is a side elevational view of our improved plastic cap for use with a hand tool, such as a magnetic screwdriver which is provided with a bit cavity and removal rear cap.

Referring now to the drawings, and in particular to FIGS. 1–3, there is shown a hand tool, such as a screwdriver 10, having a handle 12 with a cavity 13, a cap 14, elongated shank 16, preferably hexagonal in section, which is suitably secured to the handle 12, and suitable hexagonal driver sleeve 18 secured to the elongated shank 16. The recess 20 in the hexagonal driver sleeve 18 is provided with a magnet 22 for holding or retaining in place a typical hexagonal tool bit (not shown) there at, but shown by the reference numeral 24 in the cavity 26 of the handle 12. The handle 12 may be of any desired shape, such as round, polygonal, square, etc., and may also be suitably provided with gripping means or grooves-ribs 28, similar to those shown diagrammatically on the cap 14, is best seen in FIGS. 1 and 2.

The cap 14 may also be provided with a small protuberance 30 near the bottom 32 of the hexagonal recess 34 for gripping and retaining the tool bit 24 in place in the cap 14. Such protuberance 30 may be suitably molded integrally with the plastic cap 14. This construction thus provides a conventional type of hand tool/screwdriver having a tool bit cavity and removable cap with a second small, stubby or finger tip sized adjustment screwdriver. Such small tool is generally required by mechanics who maintain and control various apparatus and machinery where one must periodically adjust one or more control screws or other fine adjustment elements of a machine.

As best shown in FIGS. 4–6, there is an alternate cap 33 embodying a metal insert 36 having a dual recess area with a magnet 38 disposed and suitably held in a generally midpoint area of the sleeve-like insert 36. The magnet 38 securely holds the tool bit 24 in place in the front hexagonal recessed area 40. A back end recessed area is suitably of square shape 42 for mating with a conventional ¼ inch square drive element (not shown). Other suitable drive recesses, such as conventional hexagonal recesses for mating with Allen wrenches may also be employed in the practice of the invention. Other tool driver means, with or without an extension, such as a small, non-electrical ratchet wrench, may also be used. As in the case of FIGS. 1–3, threads 44 shown in both embodiments, are used to secure the removable caps 14 or 33 to the handle 12. Groove-ribs 28 shown on the caps 14 and 33 of the embodiments of FIGS. 1–6 may also be matched on the gripping portion of the handle 12.

Figure 7:
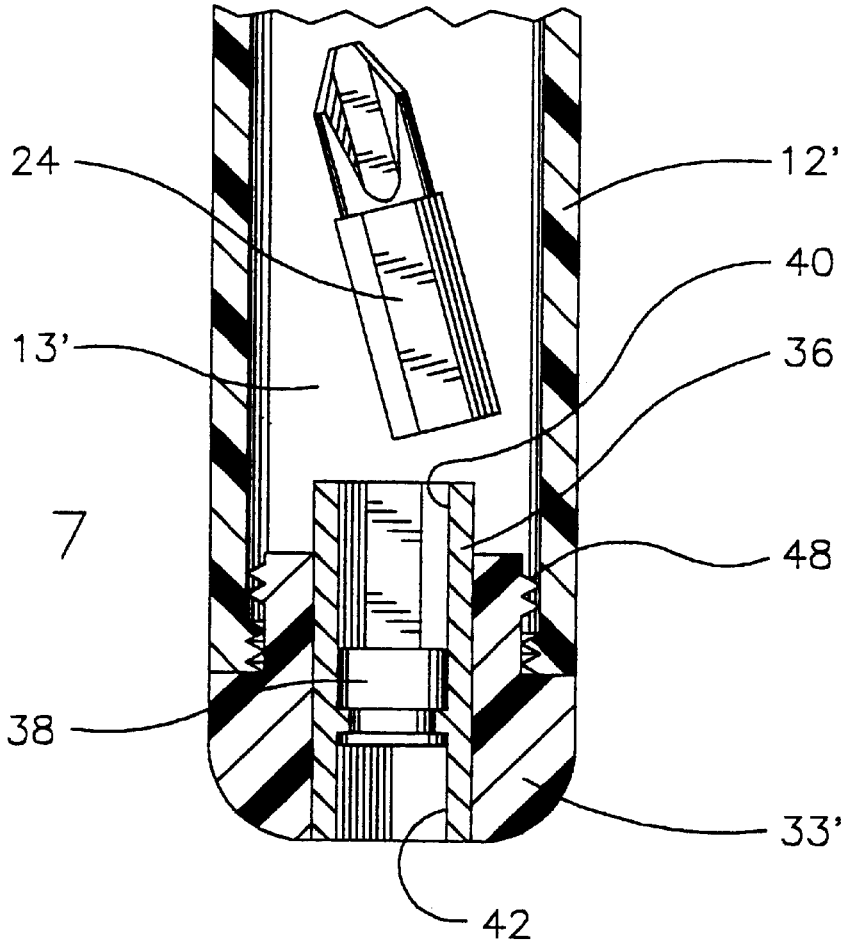
FIG. 7 is another alternative construction similar to that of FIGS. 4–6, shown in cross sectional view, and broken away, but where the improved plastic cap is provided with special or shortened thread means enabling the improved cap when threaded into the handle cavity to be rotatively locked in place due to the shortened threaded means being driven past the inner mating cavity thread means, thereby permitting the locked cap to spin about the disengaged juxtaposed thread means.
Figure 8:
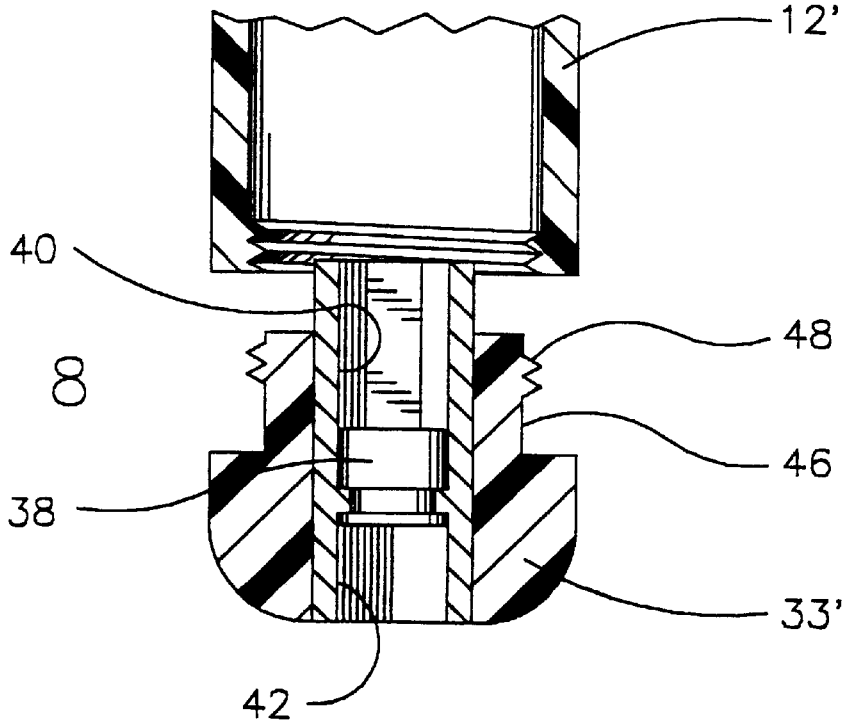
FIG. 8 is a disassembled view in cross section of the improved cap shown in FIG. 7.

In FIGS. 7 and 8, a modified cap 33' is shown with the cap 33' having a neck area 46 and thread means in the form of partial threads 48, preferably three, suitably disposed uniformly, in the 120° zones about the neck diameter such that for initiating or removing the cap's thread means from like mating threads in the tool handle, the cap 33' will go on or come off in about two-thirds of a revolution. Thus, while the cap 33' can easily be threaded to the handle 12', outward axial pressure must be applied to the cap 33' (see FIG. 8) in order to commence thread engagement between the partial thread means 48 of the cap and handle. As can be appreciated from the thread construction, once the cap threads 48 are rotated past the mating recess thread means, the cap is rotatively locked in place to the handle 12'. Only when the cap 33' is pulled axially outwardly and rotated will the mating thread means engage for removal of the cap 33' from the handle 12'. Preferably, a three start thread is employed, although other like thread means could be employed (two, four or more thread means, depending upon the tool size or cap diameter). Alternatively, multiple "bayonet type" locking means could be used to fixedly lock the cap in place to the handle, in lieu of the "spinning" cap modification.

Although the present invention has been described in some detail by way of illustration and example for purposes of clarity and understanding, it will, of course be understood that various changes and modifications may be made in the form, details and arrangements of the parts without departing from the scope of the invention as set forth in the following claims.

What is claimed is:

1. A hand tool comprising:

a handle having a distal end formed with a cavity and a proximate end having threads, a plurality of tool bit drive means each having a non-circular cross-section, a shank having a distal end and a proximate end, said distal end being formed with an opening for operably receiving at least one of said tool bit drive means, said proximate end being received in said handle distal end cavity, a cap comprising a unitary one-piece body formed with threads for cooperatively inter-engaging said handle threads for cap removal, said body being formed with a centrally disposed non-circular recess for operably receiving at least one of said tool bit drive means, said body being formed with protuberance means disposed in the cap recess for grippingly holding one of the tool bit drive means, whereby the hand tool is alternatively a handle drive tool or a cap drive tool.

2. The hand tool of claim 1, wherein the cap body consists essentially of plastic.

3. The hand tool of claim 1, wherein each tool bit drive is metal and the cap body is substantially free of metal construction.

4. The hand tool of claim 1, wherein said cap recess comprises a proximate end wall and the protuberance means being formed at the end wall.

5. A hand tool comprising:

a handle having a distal end formed with a cavity and a proximate end and having threads at the proximate end, a plurality of ferrometallic tool bit drive means each having a non-circular cross-section, a shank having a distal end and a proximate end, said distal end being formed with an opening for operably receiving at least one of said tool bit drive means, said proximate end being received in said handle distal end cavity, a magnet, a cap comprising a body formed with threads for cooperatively inter-engaging said handle threads for cap removal, said body having a central hole, a metal sleeve being disposed in said central hold, said sleeve having a distal end non-circular cross-section and a proximate end non-circular cross-section, and means for retaining said magnet between said sleeve proximate end and sleeve distal end, wherein one of said tool bit drive means is disposed in said sleeve distal end and held by said magnet, and wherein said sleeve proximate end comprises a wrench drive recess, whereby the hand tool is alternatively a handle tool bit drive tool and with the cap removed, a cap tool bit drive tool or a wrench drive tool.

6. The hand tool of claim 5, said magnet being formed with a circumferential groove, and said means for retaining said magnet comprising a circumferential ridge in the sleeve.

7. The hand tool of claim 5, said magnet being disposed more adjacent to the proximate end than the distal end of the cap sleeve.

8. The hand tool of claim 5, said magnet having a proximate end and a distal end, said magnet proximate end being operably disposed for wrench drive tool use and said magnet distal end being operably disposed for cap tool bit drive use.

9. The hand tool of claim 8, said magnet being disposed more adjacent to the proximate end than the distal end of the cap sleeve.

10. The hand tool of claim 5, said sleeve distal end extending distally away from the cap body.

11. The hand tool of claim 10, said sleeve distal end extending into the handle cavity.

12. The hand tool of claim 5, said proximate sleeve end having a square recess and said distal sleeve end having a hexagonal recess for respective use as a tool bit driver and an Allen wrench driver.

* * * * *